US005166032A

United States Patent [19]

Nakamura et al.

[11] Patent Number: 5,166,032

[45] Date of Patent: Nov. 24, 1992

[54] COLOR TONER CONTAINING ORGANIC PIGMENT AND PROCESS FOR PRODUCING THE SAME

[75] Inventors: Tatsuya Nakamura, Tokyo; Hiromi Mori, Yokohama; Masayoshi Shimamura, Kamakura; Reiko Morimoto, Yokohama, all of Japan

[73] Assignee: Canon Kabushiki Kaisha, Tokyo, Japan

[21] Appl. No.: 850,290

[22] Filed: Mar. 12, 1992

Related U.S. Application Data

[62] Division of Ser. No. 507,472, Apr. 11, 1990, Pat. No. 5,116,712.

[30] Foreign Application Priority Data

Apr. 11, 1989 [JP] Japan ..... 1-89689
Apr. 28, 1989 [JP] Japan ..... 1-107236

[51] Int. Cl.[5] ..... G03G 9/09
[52] U.S. Cl. ..... 430/137
[58] Field of Search ..... 430/137

[56] References Cited

U.S. PATENT DOCUMENTS

| | | | |
|---|---|---|---|
| 3,275,637 | 9/1966 | West . | |
| 3,344,098 | 9/1967 | Horiguchi et al. | 430/106 X |
| 4,576,888 | 3/1986 | Miyakawa et al. | 430/106 |
| 4,585,723 | 4/1986 | Kishi et al. | 430/106 |
| 4,592,990 | 6/1986 | Takagi et al. | 430/137 |
| 4,624,709 | 11/1986 | Otsuka | 430/106 X |
| 4,804,610 | 2/1989 | Mori et al. | 430/137 |
| 4,816,366 | 3/1989 | Hyosu et al. | 430/137 |
| 4,845,007 | 7/1989 | Hyosu et al. | 430/137 |
| 4,912,010 | 3/1990 | Mori et al. | 430/137 |
| 4,960,669 | 10/1990 | Mori et al. | 430/137 |

FOREIGN PATENT DOCUMENTS

| | | | |
|---|---|---|---|
| 47-40821 | 10/1972 | Japan | 430/106 |
| 49-4662 | 2/1974 | Japan | 420/106 |
| 223756 | 9/1988 | Japan | 430/137 |
| 250660 | 10/1988 | Japan | 430/137 |
| 7510079 | 1/1976 | Netherlands | 430/106 |
| 1231856 | 5/1971 | United Kingdom | 430/106 |

OTHER PUBLICATIONS

Patent Abstract of Japan, vol. 11, No. 173 (P-582) (2620), Jun. 4, 1987.

Database WPIL, No. 90-095647, Derwent Publication, JPA-2047668.

*Primary Examiner*—Roland Martin

*Attorney, Agent, or Firm*—Fitzpatrick, Cella, Harper & Scinto

[57] ABSTRACT

A cooler toner, comprising a binder resin and a colorant, wherein the colorant comprises organic pigment particles treated with an isocyanic ester or a silicon-containing compound.

20 Claims, 1 Drawing Sheet

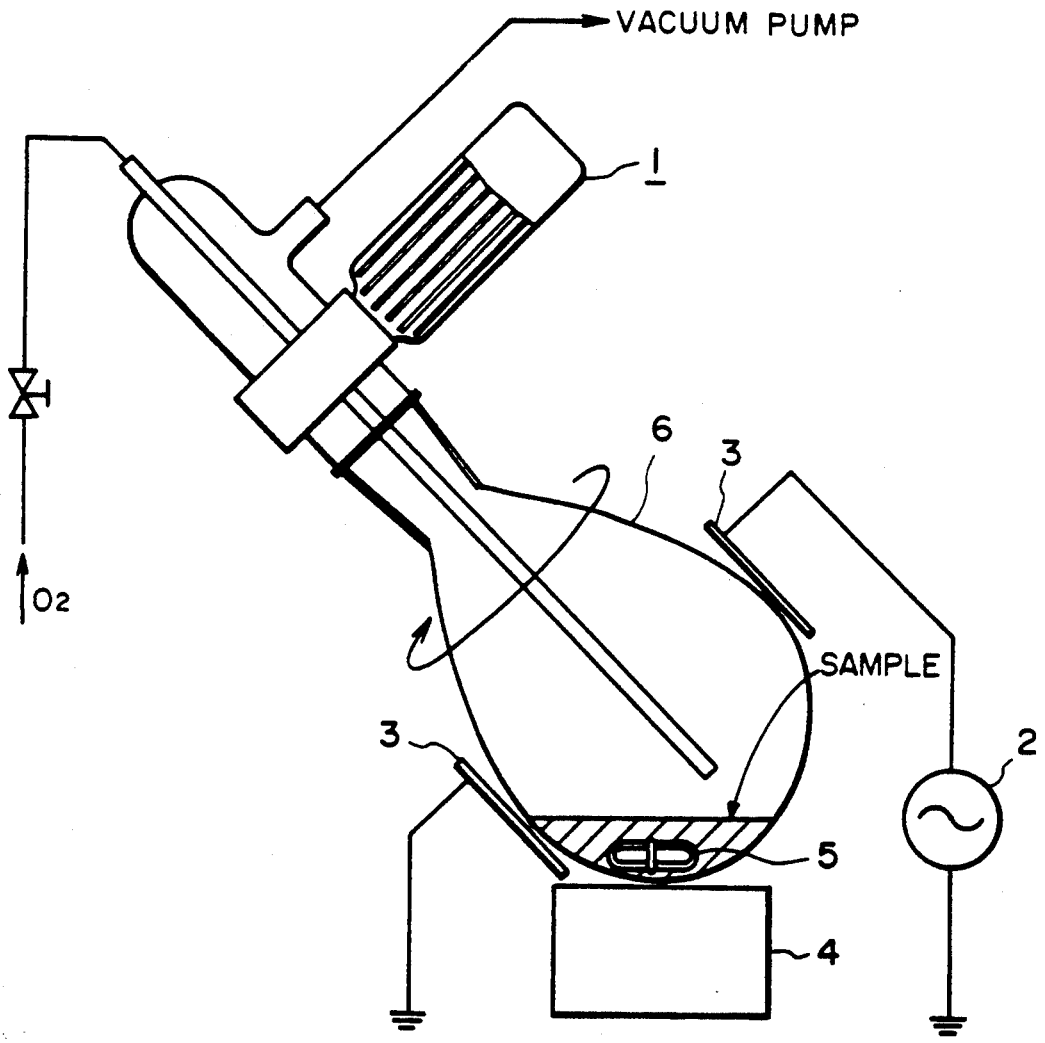
VACUUM PUMP
1
6
3
O2
SAMPLE
3
2
5
4

COLOR TONER CONTAINING ORGANIC PIGMENT AND PROCESS FOR PRODUCING THE SAME

This application is a division of application Ser. No. 07/507,472 filed Apr. 11, 1990, now U.S. Pat. No. 5,116,712.

FIELD OF THE INVENTION AND RELATED ART

The present invention relates to a color toner for developing electric latent images in image forming process such as electrophotography and electrostatography, and a process for producing such a color toner.

Hitherto, toners have been manufactured by melt-mixing a colorant into a thermoplastic resin to be dispersed therein, cooling the resultant kneaded product, and pulverizing and classifying the product into desired particle sizes by means of a micropulverizer and a classifier.

In the case of a color toner, an organic dye or organic pigment is generally used as the colorant. The organic dye is superior to the organic pigment in dispersibility in a resin, but is inferior in weather resistance. Accordingly, the organic pigment tends to be used as the colorant for color toner. However, since the organic pigment is inferior to the organic dye in dispersibility in a resin, an improvement thereof has been desired.

On the other hand, the above-mentioned production process for toner (i.e., pulverization process) comprising the steps of melt-kneading and pulverization is capable of producing considerably excellent toners but accompanied with potential problems such that the selection of the material therefor is rather limited. For example, a block of a resin composition containing a colorant dispersed therein is required to be sufficiently brittle or fragile so that it may be micro-pulverized by means of an economically usable production device.

In order to solve the problems of the pulverization process, it has been proposed to produce a toner through suspension polymerization, as described in Japanese Patent Publication (JP-B, KOKOKU) Nos. 10231/1961, 10799/1968 and 14895/1976, and U.S. Pat. No. 4,592,990.

In the suspension polymerization process proposed heretofor, a monomer composition comprising a polymerizable monomer, a polymerization initiator and a colorant (optionally, further comprising an additive such as crosslinking agent and charge-controlling agent) is charged into a continuous phase (e.g., an aqueous phase) containing a suspension (or dispersion) stabilizer, the polymerizable monomer composition is formed into particles by means of an appropriate stirrer, and the polymerizable composition is subjected to polymerization thereby to form toner particles having a desired particle size.

This process has a characteristic such that it does not cause the above-mentioned troubles based on the pulverization step in the pulverization process, because no pulverization step is involved therein. Further, the resultant toner has shapes close to spheres to be excellent in fluidity, so that it has a uniform triboelectric charging characteristic.

However, the toner produced through suspension polymerization (hereafter, such a toner is sometimes referred to as "polymerization toner") having the above-mentioned excellent characteristics still has a problem to be solved. More specifically, since the polymerization toner may be produced by forming a polymerizable monomer composition into particles in an aqueous medium such as water, and subjecting the resultant particles to polymerization, it is difficult to use a material which provides poor dispersion stability in the polymerizable monomer composition, is hydrophilic, or inhibits a radical reaction. As a result, with respect to a colorant which is essential to a color toner, selection of materials has been severely restricted.

For example, when dyes are used as the colorant, they cause substantially no problem in dispersion stability since most of dyes are soluble in a monomer. However, since most of the dyes have a Polymerization-inhibiting property, it is impossible or extremely difficult to obtain a cured or hardened product. When an organic pigment is used as the colorant, it causes substantially no problem in the polymerization-inhibiting property, but can pose a problem in dispersion stability so that the organic pigment is liable to agglomerate during the granulating (or particle formation) step. As a result, the granulation stability become spoor, and the resultant toner tends to have broad particle size distribution an tends to be lacking in uniformity. As described above, each of the dye and organic pigment as the colorant has both merits and demerits, but it is preferred to use the organic pigment in view of the material cost and weather resistance.

On the other hand, reduction in toner consumption has recently been desired in copying machines. One of the measures for attaining such reduction is to enhance the coloring power (or tinting strength) of a toner. In order to enhance the coloring power, there may be used a method of enhancing the dispersibility of a colorant and preventing the colorant from agglomerating so that the colorant may be uniformly dispersed int eh toner particles.

In the process for producing a polymerization toner, it is important to enhance the dispersibility of a colorant, particularly an organic pigment, in a monomer composition. In order to enhance the dispersibility of the colorant in the polymerizable monomer composition and to prevent the colorant from migrating to the aqueous phase, it is conceivable to use a method of surface-treating an organic pigment.

The method of surface-treating organic pigments has heretofore been investigated, and examples thereof include a method of converting a pigment into its derivative, a method of coating a pigment with a resin, etc.

More specifically, with respect to the derivation of organic pigments, Japanese Laid-Open Patent Application (JP-A, KOKAI) No. 15930/1973 discloses aminoalkylation of a copper phthalocyanine pigment; Japanese Laid-Open Patent Application No. 168666/1986 and U.S. Pat. No. 3,275,637 disclose introduction of a substituent to a quinacridone-type pigment; and Japanese Laid-Open Patent Application No. 28162/1982 discloses intermolecular coupling of a naphthol-type pigment. In these methods, the organic pigment is treated by using a chemical bond. However, different treatment operations are used with respect to the respective organic pigments, and the thus-treated organic pigments respectively have different properties. Accordingly, these methods pose a problem in view of production cost or uniformization in the prescription for the polymerization process.

Further, Japanese Laid-Open Patent Application No. 7648/1983 discloses a toner using a pigment treated with a titanium coupling agent. However, the pigments specifically described in this application are inorganic pigments of magnetic material and carbon black. The treatment using a titanium coupling agent has no or little effect on organic pigment particles having surfaces with no reactive site.

On the other hand, resin coating may be used as a surface treating method which is applicable to various species of pigments. For example, Japanese Laid-Open Patent Application No. 215461/1983 discloses a method of coating a pigment with an acrylic acid aminoalkylate-type polymer; and Japanese Patent Publication No. 14273/1972 discloses a method of coating a pigment with a urea-type resin. When the thus obtained resin-coated pigment is dispersed in a monomer composition to be used in suspension polymerization, etc., the monomer functions as a solvent and the coating of the resin tends to be dissolved therein and to be separated from the pigment. As a result, there can be obtained poor results such that the intended dispersibility is deteriorated and the separated polymer has a detrimental effect on the particle-forming property of the monomer composition or physical property of the resultant toner.

As described hereinabove, the conventional surface-treating methods for an organic pigment suitable for suspension polymerization are still insufficient. Accordingly, an improvement of such a surface-treating method suitable for polymerization toner for color copying (particularly, for full-color copying) has been desired with respect to the production cost and performances of the resultant polymerization toner.

SUMMARY OF THE INVENTION

An object of the present invention is to provide a color toner and a production process therefor which have solved the above-mentioned problems encountered in the prior art.

Another object of the present invention is to provide a color toner containing an organic pigment well dispersed therein, and a production process therefor.

A further object of the present invention is to provide a color toner which not only has a good spectral reflection property, color-mixing property and transparency, but also has a good developing property (i.e., resolution property or image reproducibility; and a production process therefor.

A further object of the present invention is to provide a color toner having stable charging property and excellent developing property based on good dispersibility of an organic pigment at the time of polymerization of a monomer composition; and a production process therefor.

According to the present invention, there is provided a color toner, comprising a binder resin and a colorant, wherein the colorant comprises organic pigment particles treated with an isocyanic ester or a silicon-containing compound.

The present invention also provides a process for producing a color toner, comprising:

mixing a polymerizable monomer and an organic pigment treated with an isocyanic ester or silicon-containing compound, thereby to prepare a monomer composition;

adding the monomer composition to an aqueous dispersion medium;

forming particles of the monomer composition in the aqueous dispersion medium;

polymerizing the polymerizable monomer contained in the monomer composition particles, thereby to produce colored resinous particles; and producing a color toner from the colored resinous particles.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

The sole FIGURE in the accompanying drawing is a sectional view schematically sowing a device used for effecting a plasma treatment.

DETAILED DESCRIPTION OF THE INVENTION

As a result of earnest study, we have found that the dispersibility of an organic pigment in a polymerizable monomer or binder resin may be remarkably improved by treating the organic pigment with an isocyanate (or isocyanic ester) or a silicon-containing compound.

In the case of a process for producing a toner using suspension polymerization, since a strong shear force is generally applied to a monomer composition at the step of preparation thereof, the dispersibility of an organic pigment is relatively good as compared with that in a pulverization process for a toner. In the suspension polymerization process, however, the organic pigment once dispersed is present in the polymerizable monomer composition having a low viscosity until the completion of the polymerization, and therefore there can be posed a problem such that the dispersed organic pigment particles again agglomerate (or aggregate). In the present invention, the dispersibility of the organic pigment may further be enhanced by retaining the dispersion stability of the dispersed organic pigment. In the present invention, when a bulky group and/or a lipophilic group is introduced into the surfaces of organic pigment particles, re-agglomeration (or re-aggregation) of the dispersed organic pigment particles is prevented by utilizing the steric hindrance and/or lipophilic property of the above-mentioned group, whereby the dispersibility of the organic pigment may remarkably be improved.

The isocyanate used in the present invention may include those having an isocyanate group in the polymer chain or side chain thereof. When such an isocyanate is used, the reaction mechanism may for example be considered as follows:

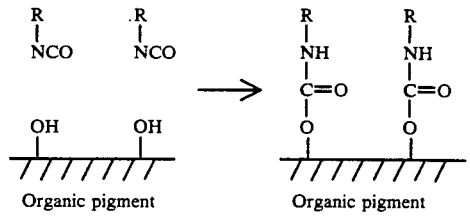

In the present invention, the isocyanate used for treating a pigment is not particularly restricted. The isocyanate may be sued in the form of a liquid, a gas or a non-aqueous solution. In the present invention, the isocyanate may be caused to contact the organic pigment so that a chemical bond to the hydroxyl group of the organic pigment surface is formed on the basis of an addition reaction.

In a case where a gaseous isocyanate compound is used for such treatment, dried organic pigment particles may preferably be treated in an atmosphere of saturated isocyanate compound at a high temperature of 100°-200° C. for about 0.1 to 10 hours (e.g., about one hour). In a case where organic pigment particles are treated in a non-aqueous solution, the particles may preferably be subjected to milling in the non-aqueous solution of an isocyanate compound maintained at 15° to 30° C. for 1 to 4 hours. The reaction rate may generally be increased as the temperature of the solution is elevated. However, if the reaction becomes too rapid, the organic pigment particles are liable to agglomerate. In order to attain uniform dispersion without causing such agglomeration, it is important to reduce the agglomeration by using an appropriate temperature and milling operation. Accordingly, it is preferred to conduct the milling until the completion of the treatment.

The compound may be an isocyanic ester R—N=C=O, wherein R is an alkyl group having 1-20 carbon atoms and containing no active hydrogen, an alkenyl group, an alkyl group containing 1-20 carbon atoms containing no active hydrogen and containing at least one species selected from N, S, O and halogen atoms, an alkenyl group containing no active hydrogen and containing at least one species selected form N, S, O and halogen atom and an aryl group.

The compound containing an isocyanate group may be one or more species selected from: aliphatic isocyanate compounds such as n-propyl isocyanate, butyl isocyanate, hexadecyl isocyanate, and octadecyl isocyanate; and aromatic-type isocyanate; and aromatic-type isocyanate compounds such as phenyl isocyanate, tolyl isocyanate, 3,4-dichlorophenyl isocyanate, and m-nitrophenyl isocyanate In the case of an aromatic isocyanate compound represented by Ar—N=C=O wherein Ar denotes an aromatic group, the aromatic group may preferably be a phenyl group or a phenyl group having a substituent of a lower alkyl group having 1-4 carbon atoms.

In the present invention, it is preferred to use 0.5-50 wt. parts, more preferably 1-30 wt. parts of the isocyanate, per 10 wt. parts of the organic pigment.

In the present invention, in the case of the treatment of an organic pigment with a silicon-containing compound, it is preferred to treat the organic pigment by the medium of a chemical bond, as compared with the treatment using simple coating. In order to treat the organic pigment by the medium of a chemical bond, there may be used a treatment method wherein a silane coupling agent is caused to react with the hydroxyl group of the surface of the organic pigment particles, or a method wherein a silicone polymer is caused to be formed on the active surface of an organic pigment having a hydroxyl group.

In the present invention, the silicon-containing compound used for treating the organic pigment may include: γ-(2-aminoethyl)aminopropyltri-methoxysilane, γ-aminopropyltriethoxysilane, γ-(2-aminoethyl)aminopropylmethyl-dimethoxysilane, γ-methacryloxypropyltrimethoxysilane, γ-glycidoxypropyltrimethoxysilane, methyltrimethoxysilane, ethyltriethoxysilane, γ-anilinopropyltirmethoxysilane, vinyltrimethoxysilane, and γ-chloropropylmethyldimethoxysilane.

In the present invention, a silicone polymer may be formed on the surfaces of organic pigment particles in the following manner.

And organic pigment comprising pigment particles having a hydroxyl group on their surfaces may preferably be placed in an atmosphere of at least one species of silicone compound selected from those represented by the following formula [I]:

$$(R_1HSiO)_a(R_2R_3SiO)_b(R_4R_5R_6SiO_{\frac{1}{2}})_c \quad [I],$$

wherein $R_1$, $R_2$ and $R_3$ respectively denote the same or different groups comprising a hydrogen atom or a hydrocarbon group (preferably having 1-10 carbon atoms) capable of having a substituent of a halogen atom, provided that all of $R_1$, $R_2$ and $R_3$ are not hydrogen atoms simultaneously; $R_1$, $R_5$ and $R_6$ respectively denote the same or different groups comprising a hydrogen atom or a hydrocarbon group (preferably having 1-10 carbon atoms) capable of having substituent of a halogen atom; a denotes 0 (zero) or an integer of 1 or larger; b denotes 0 (zero) or an integer of 1 or larger; and c denotes an integer of 0 (zero) or 2, provided that the sum of a and b is an integer of 3 or larger when c is 0 (zero), thereby forming a polymer comprising the silicone compound on the surfaces of the organic pigment particles.

More specifically, the silicone compounds represented by the above formula [I] may preferably comprise a first group thereof and a second group thereof.

The first group comprises compounds which correspond to those represented by the formula [I] wherein c=0, and are cyclic silicone compounds represented by the following general formula of:

$$(R_1HSiO)_a(R_2R_3SiO)_b \quad [II],$$

wherein $R_1$, $R_2$, $R_3$, a and b have the same meanings as those described above. In a preferred embodiment, in the above formula [II], $R_1$, $R_2$ and $R_3$ may respectively denote a lower alkyl group having 1-4 carbon atoms or aryl group (e.g., phenyl group) capable of having a substituent of a halogen atom, and the sum of a and b may be 3 to 7.

The second group comprises compounds which correspond to those represented by the formula [I] wherein c=2, and are linear silicone compounds represented by the following general formula:

$$(R_1HSiO)_a(R_2R_3SiO)_b(R_4R_5R_6SiO_{178})_2 \quad [III],$$

wherein $R_1$, $R_2$, $R_3$, $R_4$, $R_5$, $R_6$, a and b have the same meanings as those described above. In a preferred embodiment, in the above formula [III], $R_1$ to $R_6$ may respectively denote a lower alkyl group having 1-4 carbon atoms or aryl group capable of having a substituent of a halogen atom, and the sum of a and b may be 2 to 5.

Typical examples of the former cyclic silicone compounds are those represented by the following formulas:

(1)

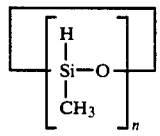

(n = 3-7)

-continued (2)

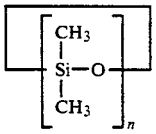

(n = 3-7)

(3)

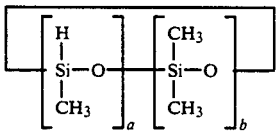

(a + b = 3-7)

These compounds may be used singly or as a mixture of two or more species thereof.

In the above-mentioned formulas, n or (a+b) may preferably be 3-7 in view of vaporization of the silicone compound, and may particularly be 3-4 in view of the reactivity of the silicone compound.

Specific examples of the cyclic silicone compound may include:
dihydrogenhexamethylcyclotetrasiloxane,
trihydrogenpentamethylcyclotetrasiloxane,
tetrahydrogentetramethylcyclotetrasiloxane,
dihydrogenoctamethylcyclopentasiloxane,
trihydrogenheptamethylcyclopentasiloxane,
tetrahydrogenhexamethylcyclopentasiloxane, and
pentahydrogenpentamethylcyclopentasiloxane.

Typical examples of the latter linear silicone compound may be those represented by the following formula:

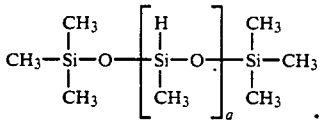

(a = 2-5)

Specific examples of the linear silicone compound may include: 1,1,1,2,3,4,4,4-octamethyltetrasiloxane, 1,1,1,2,3,4,5,5,5-nonamethylpentasiloxane, and 1,1,1,2,3,4,5,6,6,6-decamethylhexasiloxane.

The amount of the silicone compound to be used for the above-mentioned treatment may generally be 0.005-50 wt. %, more preferably 0.05-20 wt. % based on the weight of the organic pigment, while such an amount depends on the number of the active sites on the surface of the organic pigment.

In order to treat an organic pigment having activated surfaces (i.e., surfaces to which a reactive site has been introduced) with the above-mentioned silicone compound, there may be used a method wherein a vaporized organosiloxane is caused to be adsorbed to the surfaces of the organic pigment in its molecular state, and a polymerization reaction is caused to occur from the active site of the surface on the basis of a high reactivity of the Si-H or the cyclic compound. By using the above-mentioned low-molecular silicone compound, the organic pigment may be treated at a temperature of 120° C. or lower, preferably 100° C. or lower, particularly preferably 15°-80° C.

More specifically, an organic pigment to be treated is charged into a sealed (or gas-tight) vessel heated up to 120° C. or lower, preferably 100° C. or lower, and the vessel is once degassed under reduced pressure. Separately, a silicone compound is preliminarily vaporized in another sealed vessel heated up to 120° C. or lower so as to provide a predetermined partial pressure, and the thus vaporized silicone compound is introduced into the above-mentioned sealed vessel containing the organic pigment, by using a carrier gas comprising an inert gas such as nitrogen gas, whereby the organic pigment is treated with the silicone compound.

At this time, the pressure in the sealed vessel should not be particularly restricted, but may preferably be set to a pressure of 200 mmHg or below, more preferably 100 mmHg or below. The treatment time may generally be 0.5 to 100 hours, more preferably 0.5 to 20 hours. After the completion of the treatment, the unreacted silicone compound is removed by degassing, whereby a treated organic pigment is obtained.

The organic pigment used in the present invention may be any of known organic pigments. When such an organic pigment has a hydroxyl group as an active site in the chemical structure thereof, it may be treated with a silicone compound without effecting oxidation treatment thereof as described hereinbelow.

Generally speaking, the surfaces of organic pigment particles do not have an active site such as hydroxyl group. Accordingly, in order to treat such an organic pigment with a silane coupling agent, an active site may be introduced into the organic pigment. In order to introduce such an active site into an organic pigment, there may be used a method of treating a pigment with an oxidizing agent, or a method wherein a pigment is subjected to oxidation treatment by use of plasma.

As the oxidizing agent for an organic pigment used in the present invention, there may generally be used one which is capable of combining oxygen with the surface of an organic pigment due to oxidation reaction and forming a polar group on the surface. Particularly preferred examples of the oxidizing agent may include: peroxide and their derivatives such a ozone, hydrogen peroxide, and ammonium peroxydisulfate; oxoacids and salts thereof such as nitric acid and salts thereof, perchloric acid and salts thereof, hypochlorous acid and salts thereof, permanganic acid and salts thereof, and chromic acid and salts thereof.

In order to enhance the activity of the oxidizing agent, as desired, the oxidizing agent may be used in combination with an acid, alkali or oxidative catalyst.

It is not necessarily clear that the polarity due to the oxidation treatment is based on what kind of structure at the surface of the organic pigment. However, it may presumably be considered that when an oxidizing agent is caused to act on an organic pigment, the surfaces of the organic pigment particles are subjected to oxidation or decomposition, and a polar functional group is formed on the surfaces, whereby a polarity is developed.

In order to cause the oxidizing agent to act on the organic pigment, there may be used a dry process wherein an oxidative gas or vapor is caused to contact an organic pigment; and a wet process wherein an oxidizing agent is added to an aqueous suspension wherein an organic pigment is dispersed in an aqueous medium such as water, or an organic pigment is dispersed in an aqueous medium such as water containing an oxidizing agent so that the oxidizing agent acts on the organic pigment. In the present invention, the wet process is particularly preferred. When the organic pigment may be treated by the wet process, the organic pigment is dispersed in a dispersion medium to form a suspension, by using an anionic, cationic, amphoteric or nonionic surfactant, as desired.

In order to maximize the effect of the oxidation treatment, it is preferred to uniformly oxidize the surfaces of the organic pigment particles. For such a purpose, it is preferred to stir an aqueous suspension of an organic pigment at the time of the oxidation treatment. It is further preferred to effect the treatment while a shear force is applied to the organic pigment and the organic pigment particles are uniformly subjected to micro-grinding so that the surfaces to be subjected to the oxidation treatment may sufficiently be broadened.

The shear force may be produced by driving a grinding medium (or grinding aid) such as sand or spherical member of glass, ceramic, metal, etc., at a high speed in an aqueous suspension by means of a high-speed rotary stirrer. As the device used for such a purpose, it is suitable to use one generally used for dispersing a pigment, such as sand mill, ball mill and attritor. In order to effectively generate a shear force and to sufficiently broadened the organic pigment surfaces to be subjected to oxidation, the organic pigment may preferably be contained in an aqueous suspension in an amount of 1–40 wt. %, more preferably 5–30 wt. %, based on the total weight of the suspension (inclusive of the organic pigment, per se). It is generally preferred to use the grinding aid in an amount which is 0.3 to 1.5 times the volume of the aqueous suspension.

The thus oxidation-treated organic pigment may be subjected to filtration, washing and drying, and further disintegration or pulverization in a general manner, and then used in the above-mentioned manner.

When the oxidizing agent is caused to act on the organic pigment, the concentration of the oxidizing agent, oxidation treatment time, and temperature may be appropriately determined depending on the kind of the oxidizing agent. When the degree of the oxidation becomes too high, there occurs a considerable change in hue, and such a considerable change is disadvantageous. It is preferred to oxidize the organic pigment by controlling the oxidation condition so that the hue, weather resistance, fastness, etc., of the organic pigment are not substantially impaired. The temperature may preferably be 60° C. or below more preferably 15°–55° C. when the oxidizing agent acts on the organic pigment. If the temperature exceeds 60° C., the change in hue becomes considerable and the oxidation condition becomes difficult to be controlled. However, a temperature of above 60° C. can sometimes be preferred when a certain kind of pigment or oxidizing agent is used.

On the other hand, an active site may be introduced to the surface of a pigment by plasma oxidation treatment in the following manner.

The plasma oxidation treatment may generally be conducted by using a device for plasma treatment. The sole FIGURE of the accompanying drawing schematically shows a typical example of such a device. The device shown in the FIGURE comprises: a motor 1, a high-frequency power supply 2, a pair of electrodes 3 for application of high-frequency, a magnetic stirring device 4, and a magnetic stirring member 5. Hereinbelow, there is explained the plasma oxidation treatment of an organic pigment using the above-mentioned device.

An organic pigment is charged into a reaction vessel 6 and the interior of the reaction vessel 6 is degassed to reduce the pressure, thereby to sufficiently dry the organic pigment. The amount of the organic pigment to be treated, degree of pressure reduction and drying time may vary depending on the state or condition of the organic pigment. However, in an embodiment, it may be suitable to use a treating amount of about 20 g, a degree of pressure reduction of 0.2 Torr or lower, and a drying time of about one hour.

After the organic pigment is dried, while a predetermined reduced pressure is maintained, oxygen is supplied to the reaction vessel 6, the magnetic stirrer 4 is actuated, and a high frequency is applied to the reaction vessel 6, thereby to effect oxidation treatment. Respective treating conditions may vary depending on the kind of the organic pigment to be treated, the high-frequency output may suitably be 20–100W, more preferably 20–50W. If the output is below 20W, the treatment of the organic pigment can be insufficient. If the output is above 100W, ashing or incineration of the organic pigment can proceed due to combustion (or burning) on the organic pigment surface. The reduced pressure may suitably be 0.5–5 Torr, more preferably 0.5–3 Torr. If the reduced pressure is below 0.5 Torr, the concentration of oxygen in the vessel becomes low and the treatment time becomes long. If the reduced pressure is above 5 Torr, the output of the high frequency is required to be undesirably increased in order to sufficiently conduct the treatment. The treatment time may suitably be 1–60 min, more preferably 20–60 min.

The color toner according to the present invention may for example be prepared in the following manner.

A colorant and an optional additive such as wax, and polymerization initiator are added to a polymerizable monomer and are uniformly dissolved or dispersed by means of a dispersing machine such as ultrasonic dispersing machine and homogenizer, thereby to prepare a monomer composition. The thus obtained monomer composition is then dispersed in an aqueous phase (i.e., continuous phase) containing a suspension stabilizer under stirring by means of an ordinary stirrer or a strong shear-force stirrer such as homomixer and homogenizer. Preferably, the speed and time for stirring may be adjusted so that the droplets of the monomer composition have a desired toner particle size (e.g., 30 microns or below). After that, stirring is effected to such an extent that the dispersion state is substantially maintained as such while preventing the sedimentation. The polymerization temperature may be set to 40° C. or above, preferably 50°–90° C. After the completion of the reaction, the resultant toner particles are washed, recovered by filtration, and dried, thereby to obtain a polymerization toner. In the suspension polymerization, 300–3000 wt. parts of water is ordinarily used as a dispersion medium with respect to 100 wt. parts of the polymerizable monomer.

Further, 0.1–50 wt. parts (more preferably 0.5–25 wt. parts) of the organic pigment may preferably be used with respect to 100 wt. parts of the polymerizable monomer.

The polymerizable monomer applicable to the present invention may be a vinyl-type monomer. Specific examples of the vinyl monomer include: styrene and its derivatives such as styrene, o-methylstyrene, m-methylstyrene, p-methylstyrene, p-methoxystyrene, and p-ethylstyrene; methacrylic acid esters such as methyl methacrylate, ethyl methacrylate, propyl methacrylate, n-butyl methacrylate, isobutyl methacrylate, n-octylmethacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethyhexyl acrylate, stearyl acrylate, 2-chloroethyl acrylate, and phenyl acrylate; derivatives of acrylic acid and methacrylic acids such as acrylonitrile, methacrylonitrile, and acrylamide. These monomers may be used either signly or in a mixture of two or more species. Among these, it is preferred to use styrene or its derivatives alone or in combination with another monomer in view of the developing characteristics and durability of the resultant toner.

The color toner particles produced through suspension polymerization may preferably contain 0.1–50 wt. parts (more preferably 0.5–25 wt. parts) of the organic pigment, per 100 wt. parts of the binder resin component.

In the present invention, it is further preferred to polymerize the monomer while a polymer having a polar group or a copolymer having a polar group is added to the monomer at the time of polymerization.

In the present invention, it is preferred that a polymerizable monomer composition containing a polar material such as the polymer or copolymer having a polar group or cyclized rubber thus added is suspended in an aqueous phase containing a dispersant dispersed therein which has a reverse polarity to that of the polar material, and is subjected to polymerization.

The cationic polymer (inclusive of copolymer), anionic polymer (inclusive of copolymer) or anionic cyclized rubber thus contained in the polymerizable monomer composition exerts an electrostatic force at the surface of toner-forming particles with the anionic or cationic dispersant having the reverse polarity dispersed in the aqueous phase, so that the dispersant covers the surface of the particles to prevent coalescence of the particles with each other and to stabilize the dispersion. In addition, as the added polar material gathers at the surface layer of the particles, a sort of shell is formed to provide the particles with a pseudo-capsule structure. While the polar material of a relatively large molecular weight thus gathered at the particle surfaces provides the polymerization toner particles of the present invention with excellent anti-blocking characteristic, developing characteristic, and abrasion resistance, and the polymerization may be conducted in the interior thereof to provide a relatively low molecular weight which may contribute to an improvement in fixability of the toner. As a result, the resultant toner according to the present invention may satisfy both of fixability and anti-blocking characteristic which can sometimes be antagonistic to each other Specific examples of the above-mentioned polar material and the dispersant having the reverse polarity are described below.

(a) Cationic polymers (or copolymers): polymers of nitrogen-containing monomers such as dimethylaminoethyl methacrylate and diethylaminoethyl acrylate; copolymers of styrene and such a nitrogen-containing monomer; and copolymers of an unsaturated carboxylic acid ester and such a nitrogen-containing monomer.

(b) Anionic polymers (or copolymers): polymers or copolymers of a ionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and nitro-type monomers.

(c) Anionic dispersant: colloidal silica such as Aerosil #200, #300 and #380 (mfd. by Nihon Aerosil K.K.).

(d) Cationic dispersant: aluminum oxide, and hydrophilic positively chargeable silica fine powder such as aminoalkyl-modified colloidal silica.

The above-mentioned cyclized rubber may be used instead of the anionic polymer or copolymer.

The amount of addition of the dispersant may preferably be 0.2–20 wt. parts, particularly 0.3–15 wt. parts, with respect to 100 wt. parts of the polymerizable monomer.

The charge control agent which may be added as desired may be selected from those generally known in the art. Specific examples thereof may include: nigrosine, azine dyes containing an alkyl group having 2–16 carbon atoms, metal complex salts of monoazo dyes, and metal complex salts of salicylic acid, dialkylsalicylic acid, etc.

The polymerization initiator usable in the present invention may be appropriately be selected from those capable of providing a radical.

Specific examples of the polymerization initiator usable in the present invention may include: azo- or diazo-type polymerization initiators such as 2,2'-azobis-(2,4-dimethylvaleronitrile), 2,2'-azobisisobutylonitrile (AIBN), 1,1'-azobis(cyclohexane-2-carbonitrile), 2,2'-axobis-4-methoxy-2,4-dimethylvaleronitrile; and peroxide-type polymerization initiators such as benzoyl peroxide, methyl ethyl ketone peroxide, isopropyl peroxycarbonate, cumene hydroperoxide, 2,4-dichlorobenzoyl peroxide and lauroyl peroxide.

The amount of use of the polymerization initiator may generally be int he range of about 0.5–10 wt. % based on the weight of the polymerizable monomer.

In the present invention, a fluidity improver may be mixed with or externally added to the toner particles (external addition). Specific examples of the fluidity improver may include: colloidal silica, fatty acid metal salt, teflon fine powder, etc. Further, for the purpose of extension, a filler such as calcium carbonate and silica fine powder may be added to the toner in an amount of 0.5–20 wt. %.

The polymerization toner according to the present invention is applicable to the known dry system methods for developing electrostatic images including the two-component developing methods such as the cascade method, the magnetic brush method, the microtoning method and the two-component AC bias developing method; the powder cloud method and the fur brush method; the non-magnetic one-component developing method wherein the toner is carried on a toner-carrying member to be conveyed to a developing position and subjected to development thereat; and the electric field certain method wherein the toner is conveyed by an electric field curtain to a developing position and subjected to development threat.

Hereinbelow, the present invention will be described based on examples.

OXIDATION TREATMENT EXAMPLE 1 FOR ORGANIC PIGMENT

Plasma oxidation treatment of copper phthalocyanine blue (C.I. Pigment Blue 15:3)

20 g of copper phthalocyanine blue was charged in a reaction vessel 6 of a plasma oxidation treatment device as shown in the accompanying drawing, and the interior of the vessel 6 was degassed to provide a reduced pressure of 0.2 Torr, whereby the copper phthalocyanine blue was dried for about 2 hours.

After the drying, oxygen was supplied to the interior of the vessel 6 at a rate of 100 ml/min so that the reduced pressure was regulated to 1.2 torr. Then, the reaction vessel 6 was rotated by means of a motor 1 and the rotation speed of a magnetic stirring member 5 was regulated so that the copper phthalocyanine blue was sufficiently stirred. Thereafter, a high frequency (13.56 MHz, 30W) was applied to the reaction vessel 6 for 40 min. by means of a device comprising a high-frequency power supply 2 and a pair of electrodes 3 for applying a high frequency to effect an oxidation treatment, whereby an oxidation-treated organic pigment having a hydroxyl group was obtained.

OXIDATION TREATMENT EXAMPLE 2 FOR ORGANIC PIGMENT

Plasma oxidation treatment of quinacridone magenta (C.I. Pigment Red 122)

An oxidation-treated organic pigment having a hydroxyl group was prepared in the same manner as in the above-mentioned case of copper phthalocyanine blue, except that the output of a high frequency was 100W and the treatment time was 15 min.

OXIDATION TREATMENT EXAMPLE 3 FOR ORGANIC PIGMENT

Oxidation treatment of quinacridone magenta (C.I. Pigment Red 122) using an oxidizing agent (sodium hypochlorite)

25 g of quinacridone magenta was added to 200 g of an aqueous sodium hydrochlorite solution (available chlorine concentration=5%), and the resultant mixture was stirred by means of a ball mill together with 400 g of porcelain balls having a diameter of 1.5 cm at normal temperature (about 20° C.) for 48 hours, thereby to effect oxidation treatment. The resultant product was subjected to filtration, washing, drying and pulverizing, thereby to obtain an oxidation-treated organic pigment having a hydroxyl group.

Some physical properties of the above-mentioned respective organic pigment are shown in the following Table 1.

TABLE 1

Physical properties of organic pigments

| Organic pigment | | pH | IR (—OH absorption) |
|---|---|---|---|
| Copper phthalocyanine blue (C.I. Pigment Blue 15:3) | Untreated | 6.78 | None |
| | Plasma-treated | 4.91 | Observed |
| Quinacridone magenta (C.I. Pigment red 122) | Untreated | 6.78 | None |
| | Plasma-treated | 4.33 | Observed |
| | Treated with oxidizing agent | 4.85 | Observed |

EXAMPLE 1

7 wt. parts of the above-mentioned plasma-treated pigment of copper phthalocyanine blue (C.I. Pigment Blue 15:3) was added to a mixture comprising 170 wt. parts of styrene and 30 wt. parts of 2-ethylhexyl acrylate and was sufficiently dispersed therein. To the resultant mixture, 10 wt. parts of octadecyl isocyanate was added and was caused to react therewith at 60° C. for 4 hours.

Further, the following ingredients were added to the thus obtained mixture, and were dissolved or dispersed therein, while the temperature was maintained at 60° C., whereby a monomer composition was prepared.

| | |
|---|---|
| Cyclized rubber (Albex CK450, mfd. by Hoechst Japan, K.K.) | 10 wt. parts |
| Paraffin Wax (melting point = 155° F.) (mfd. by Nihon Seiro K.K.) | 32 wt. parts |
| Crosslinking agent | 1 wt. part |

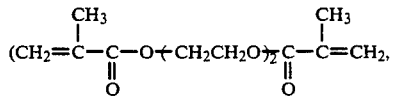

trade name: NK-2G, mfd. by Shin-Nakamura Kagaku)

| | |
|---|---|
| Polymerization initiator (2,2'-azobis(2,4-dimethylvaleronitrile) trade name: V-65, mfd. by Wako Junyaku K.K.) | 10 wt. parts |

Separately, 10 wt. parts of colloidal silica (inorganic dispersion stabilizer) treated with aminoalkylsilane coupling agent was added to 1200 wt. parts of ion-exchanged water, and the pH value thereof was adjusted to pH of 6 by using hydrochloric acid, thereby to prepare an aqueous dispersion medium. To the resultant aqueous dispersion medium, the above-mentioned monomer composition was added, and the resultant mixture was stirred in an $N_2$-atmosphere at 60° C. for 60 minutes by means of a TK-homomixer (mfd. by Tokushu Kika Kogyo K.K.) rotating at 8,000 rpm to granulate the monomer composition, thereby to prepare a dispersion. The dispersion was then subjected to polymerization under heating and stirring by means of a paddle stirrer for 20 hours at 60° C.

After the reaction product was cooled to room temperature, sodium hydroxide was added thereto to dissolve the dispersant. Thereafter, the resultant product was subjected to filtration, washing and drying, thereby to obtain a cyan toner.

The thus obtained cyan toner had a volume-average particle size of 10.5 microns, when measured by means of Coulter Counter TA-11 with a 100 micron-aperture.

5 wt. parts of the cyan toner and 95 wt. parts of iron powder (200 mesh-pass and 300 mesh-on) were charged into a 50 ml-container of polyethylene and the resultant mixture was shaken 150 times. When the triboelectric charge amount of the cyan toner was measured according to the blow-off method, it had a triboelecric charge amount of $-20\ \mu C/g$.

When the cyan toner was observed with an optical microscope (magnification=100 to 200), it was found that organic pigment particles were uniformly dispersed in the toner particles, and the organic pigment was contained even in toner particles having a particle size of 2 microns or smaller. Further, toner particles containing no organic pigment were not substantially observed.

0.5 wt. part of negatively chargeable hydrophobic colloidal silica was mixed with 100 wt. parts of the cyan toner prepared above, thereby to prepare a cyan toner comprising toner particles having colloidal silica on their surfaces. 8 wt. parts of the cyan toner containing the colloidal silica attached to the toner particle surfaces was mixed with 92 wt. parts of ferrite carrier coated with styrene-acrylic resin, thereby to prepare a two-component developer.

The two-component developer was charged into a copying machine (trade name: NP-3525, mfd. by Canon K.K.) which had been modified so as to effect development by a reversal development system, and subjected to image formation. As a result, the cyan toner images formed on plain paper had high quality without fog and had a stable image density of 1.4 or higher. Further, when toner images were transferred to a transparency for an overhead projection (OHP) in the same manner as described above, cyan toner images having a good light-transmissive property (or transparency) were obtained.

EXAMPLE 2

A magenta toner was prepared in the same manner as in Example 1 except that the plasma-treated quinacridone magenta (C.I. Pigment Red 122) described above was used as the organic pigment.

The thus obtained magenta toner had a volume-average particle size of 10.8 microns, when measured by means of Coulter Counter TA-II with a 100 micron-aperture.

5 wt. parts of the magenta toner and 95 wt. parts of iron powder (200 mesh-pass and 300 mesh-on) were charged into a 50 ml-container of polyethylene and the resultant mixture was shaken 150 times. When the triboelectric charge amount of the magenta toner was measured according to the blow-off method, it had a triboelectric charge amount of $-19\ \mu C/g$.

When the magenta toner was observed with an optical microscope (magnification=100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.5 wt. part of negatively chargeable hydrophobic colloidal silica was mixed with 100 wt. parts of the magenta toner prepared above, thereby to prepare a magenta toner comprising toner particles having colloidal silica on their surfaces. 8 wt. parts of the magenta toner containing the colloidal silica attached to the toner particle surfaces was mixed with 92 wt. parts of ferrite carrier coated with styrene-acrylic resin, thereby to prepare a two-component developer.

The two-component developer was charged into a copying machine (trade name: NP-3525, mfd. by Canon K.K.) which had been modified so as to effect reversal development, and subjected to image formation. As a result, the magenta toner images formed on plain paper had high quality without fog and had a stable image density of 1.4 or higher. Further, when toner images were transferred to a transparency in the same manner as described above, magenta toner images having a good light-transmissive property were obtained.

EXAMPLE 3

A magenta toner was prepared in the same manner as in Example 1 except that the quinacridone magenta (C.I. Pigment Red 122) treated with the oxidizing agent described above was used as the organic pigment, and 10 wt. parts of a styrene-dimethnylamino methacrylate copolymer (copolymerization mol. ratio=9.1, $\overline{Mn}$ (number-average molecular weight)=20,000) was used instead of the cyclized rubber.

The thus obtained magenta toner had a volume-average particle size of 11 0 microns, when measured by means of Coulter Counter TA-11 with a 100 micron-aperture.

5 wt. parts of he magenta toner and 95 wt. parts of iron powder (200 mesh-pass and 300 mesh-on) were charged into a 50 ml-container of polyethylene and the resultant mixture was shaken 150 times. When the triboelectric charge amount of the magenta toner was measured according to the blow-off method, it had a triboelectric charge amount of $+20\ \mu C/g$.

When the magenta toner was observed with an optical microscope (magnification=100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.5 wt. part of positively chargeable hydrophobic colloidal silica treated with amino-modified silicone oil was mixed with 100 wt. parts of the magenta toner prepared above, thereby to prepare a magenta toner comprising toner particles having colloidal silica on their surfaces. 8 wt. parts of the magenta toner containing the colloidal silica attached to the toner particle surfaces was mixed with 92 wt. parts of ferrite carrier coated with styrene-acrylic resin, thereby to prepare a two-component developer The two-component developer was charged into a copying machine (trade name: NP-3525, mfd. by Canon K.K.) and subjected to image formation. According to the normal development system. As a result, the magenta toner images formed on plain paper had high quality without fog and had a stable image density of 1.4 or higher. Further, when toner images were transferred to a transparency in the same manner as described above, magenta toner images having a good light-transmissive property were obtained.

COMPARATIVE EXAMPLE 1

A cyan toner was prepared in the same manner as in Example 1 except that copper phthalocyanaine blue (C.I. Pigment Blue 15:3) which had not been treated with octadecyl isocyanate was used.

The thus obtained cyan toner had a volume-average particle size of 10.9 microns, when measured by means of Coulter Counter TA-II with a 100 micron-aperture.

When the triboelectric charge amount of the resultant cyan toner was measured according to the blow-off method using iron powder (200/300 mesh), it had a triboelectric charge amount of $-19\ \mu C/g$.

When the cyan toner was observed with an optical microscope, it was found that the toner particles having a particle size of above 2 microns contained the pigment but about 40% by number (based on the total number of toner particles of 2 microns or below) of toner particles having a particle size of 2 microns or smaller contained no organic pigment.

COMPARATIVE EXAMPLE 2

A magenta toner was prepared in the same manner as in Example 1 except that quinacridone magenta (C.I. Pigment Red 122) which had not been treated with octadecyl isocyanate was used.

The thus obtained magenta toner had a volume-average particle size of 11.2 microns, when measured by means of Coulter Counter TA-11 with a 100 micron-aperture.

When the triboelectric charge amount of the resultant cyan toner was measured according to the blow-off method using iron powder (200/300 mesh), it had a triboelectric charge amount of $-18\ \mu C/g$.

When the magenta toner was observed with an optical microscope, it was found that the toner particles having a particle size of above 2 microns contained the organic pigment but about 35% by number (based on the total number of toner particles of 2 microns or below) of toner particles having a particle size of 2 microns or smaller contained no organic pigment.

By using the two-component developer containing the cyan toners obtained in Example 1 and Comparative Example 1, and the two-component developer containing the magenta toners obtained in Example 2 and Comparative Example 2, image formation was effected by means of a copying machine (trade name: CLC-1, mfd. by Canon K.K.), and the chromaticity values and saturation values (a*, b*, c* and L*) of the respective toners were measured. Further, toner images were transferred to a film for OHP (overhead projector) and fixed thereto, and the spectral transmittances of the thus fixed toner images were measured. The results are shown in the following Table 2.

TABLE 2

| Toner | Color | a* | b* | c* | L* | Spectral transmittance (wavelength for measurement) |
|---|---|---|---|---|---|---|
| Example 1 | Cyan | −11.5 | −44.9 | 46.4 | 47.4 | 54% (460 nm) |
| Example 2 | Magenta | 56.3 | −24.4 | 61.4 | 56.3 | 56% (660 nm) |
| Comp. Example 1 | Cyan | −14.9 | −44.7 | 47.1 | 54.2 | 43% (460 nm) |
| Comp. Example 2 | Magenta | 55.2 | −16.9 | 57.7 | 61.6 | 44% (660 nm) |

The chromaticity value used herein was measured in the following manner.

Totally 6 colors of solid image samples are prepared on plain paper or OHP sheet as a transfer sheet. The solid images in the respective colors are adjusted to have an image density in the range of 1.5±0.2 according to measurement by a reflection densitometer (preferably Model RD-914 available from McBeth Co.).

Such solid images may for example be obtained by using a laser color copying machine (CLC-1 available from Canon K.K.) under set conditions of a toner concentration of 9–10% for each of magenta and cyan and a potential contrast of 150–250V and environmental conditions of 23° C., 60%RH.

These solid images are subjected to measurement of spectral reflectances in the range of 390–730 nm by using a high-speed spectral luminance meter (available from Marukami Shikisai Kenkyusho K.K.).

Then, the tristimulus values of X, Y and Z of each solid image sample are measured according to JIS Z-8722 "Method of Measurement for Color of Materials Based on the CIE 1976 Standard Colorimetric System", and chromaticity values (a*, b*, c* and L*) are obtained from the tristimulus values.

Hereinbelow, there are described examples wherein organic pigment particles having hydroxyl groups based on oxidation treatment were treated with a silicon-containing compound so that they had lipophilicity.

LIPOPHILICITY-IMPARTING TREATMENT EXAMPLE 1

20 g of oxidation-treated β-copper phthalocyanine blue (Oxidation Treatment Example 1) and 20 g of tetramethyltetrahydrocyclotetrasiloxane represented by the following formula:

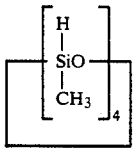

were respectively charged in different containers, and these containers were left standing in the same desiccator at 50° C. for six hours. Thereafter, the container containing the organic pigment was left standing in a vacuum dryer under reduced pressure at 50° C. for 2 hours to dry the pigment, whereby 20.4 g of a treated organic pigment was obtained.

LIPOPHILICITY-IMPARTING TREATMENT EXAMPLE 2

20 g of oxidation-treated quinacridone magenta (Oxidation Treatment Example 2) and 20 g of hexamethylcyclotrisiloxane represented by the following formula:

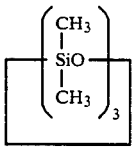

were respectively charged in different containers, and these containers were left standing in a vacuum dryer under a reduced pressure of 300 mmHg at 30° C. for four hours. Thereafter, the atmosphere in the vacuum dryer was replaced by nitrogen gas, and then the container containing the organic pigment was left standing in the vacuum dryer under vacuum at 30° C. for 2 hours to dry the pigment, whereby 20.6 g of a treated organic pigment was obtained.

LIPOPHILICITY-IMPARTING TREATMENT EXAMPLE 3

20 g of oxidation-treated quinacridone magenta (Oxidation Treatment Example 3) and 20 g of a silicone compound represented by the following formula:

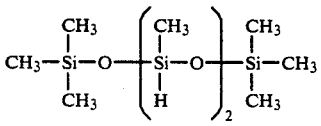

were respectively charged in different containers, and these containers were left standing in the same desiccator at 80° C. for three hours. Thereafter, the container containing the organic pigment was left standing in a vacuum dryer under reduced pressure at 50° C. for 2 hours to dry the pigment, whereby 20.8 g of a treated organic pigment was obtained.

LIPOPHILICITY-IMPARTING TREATMENT EXAMPLE 4

5 g of γ-(2-aminoethyl)aminopropyltrimethoxysilane was added to 200 g of water, and 20 g of the oxidation-treated quinacridone magenta (Oxidation Treatment Example 3) was added thereto under vigorous stirring. Thereafter, the resultant mixture was vigorously stirred for 30 min at normal temperature, and then subjected to filtration and drying, thereby to obtain 20.4 g of a treated pigment.

Examples of the color toner using the above-mentioned treated organic pigments are described hereinbelow.

EXAMPLE 4

| | |
|---|---|
| Styrene | 183 wt. parts |
| 2-Ethylhexyl acrylate | 17 wt. parts |
| Paraffin Wax T-550 (mfd. by Taisei Kosan) | 32 wt. parts |
| Cyan-type organic pigment (prepared in the above Lipophilicity-imparting Treatment Example 1) | 8 wt. parts |
| Chromium complex of di-tert-butylsalicylic acid | 6 wt. parts |

The above ingredients were heated in a container up to 70° C. and were dissolved or dispersed by means of an ultrasonic dispersing device (10 KHz, 200W), thereby to obtain a monomer mixture. Further, while the mixture was maintained at 70° C., 10 wt. parts of a polymerization initiator (dimethyl 2,2'-azobisisobutyrate, trade name: V-601, mfd. by Wako Junyaku) was added to the mixture and dissolved therein, thereby to prepare a monomer composition.

Separately, 0.25 Wt. part of γ-aminopropyltrimethoxysilane was added to 1200 wt. parts of ion-exchanged water, and 5 wt. parts of hydrophilic colloidal silica fine powder (trade name: Aerosil 200, mfd. by Nihon Aerosil) was added thereto, and dispersed therein at 70° C. by means of a strong-shear force stirrer (TK-type Homomixer M, mfd by Tokushu Kika Kogyo) at 10,000 rpm for 15 min, to prepare an aqueous dispersion medium. Thereafter, the pH value of the aqueous dispersion medium was adjusted to 6 by using 1/10 N-HCl.

To the resultant aqueous dispersion medium contained in a flask, the above-mentioned monomer composition was added, and the resultant mixture was stirred in an $N_2$-atmosphere at 70° C. for 60 minutes by means of a TK-homomixer (mfd. by Tokushu Kika Kogyo K.K.) rotating at 7,500 rpm to granulate the monomer composition, thereby to prepare a dispersion. The dispersion was then subjected to polymerization under stirring by means of a paddle stirrer for 20 hours at 70° C.

After the completion of the polymerization, the reaction product was cooled to room temperature, and sodium hydroxide was added thereto to dissolve the dispersant. Thereafter, the resultant product was subjected to filtration, washing and drying, thereby to obtain a cyan toner.

The thus obtained cyan toner has a volume-average particle size of 11.2 microns and a sharp particle size distribution, when measured by means of Coulter Counter with a 100 micron-aperture. The triboelectric charge amount of the resultant cyan toner was measured according to the blow-off method using iron powder (200/300 mesh), it had a triboelectric charge amount of −20 μC/g.

When the cyan toner was observed with an optical microscope (magnification = 100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.8 wt. part of negatively chargeable hydrophobic colloidal silica (Tullanox 500, mfd. by Tulco Co.) was mixed with 100 wt. parts of the cyan toner prepared above, thereby to prepare a cyan toner comprising toner particles having colloidal silica on their surfaces. 8 wt. parts of the cyan toner containing the colloidal silica attached to the toner particle surfaces was mixed with 92 wt. parts of ferrite carrier coated with styrene-acrylic resin, thereby to prepare a two-component developer.

The two-component developer was charged into a copying machine for color image formation (trade name: CLC-1, mfd. by Canon K.K.), and subjected to successive image formation of 20,000 sheets. As a result, the copied images formed on plain paper were clear without fog, showed a cyan color having good spectral reflection characteristic and had a stable image density of 1.4 or higher. Further, when toner images were transferred to an OHP film in the same manner as described above, cyan toner images having good light-transmissive property were obtained

EXAMPLE 5

A magenta toner was prepared in the same manner as in Example 4 except for using the following prescription instead of that used in Example 4.

| | |
|---|---|
| Styrene | 183 wt. parts |
| 2-Ethylhexyl acrylate | 17 wt. parts |
| Paraffin Wax T-550 (mfd. by Taisei Kosan) | 32 wt. parts |
| Styrene-dimethylaminoethyl methacrylate (mol ratio = 88:10:2, $\overline{M}w$ (weight-average molecular weight) = 58,000) | 10 wt. parts |
| Magenta-type organic pigment (prepared in the above Lipophilicity-imparting Treatment Example 2) | 10 wt. parts |

The thus obtained magenta toner had a volume-average particle size of 11.0 microns and a sharp particle size distribution, when measured by means of Coulter Counter with a 100 micron-aperture. The triboelectric charge amount of the resultant cyan toner was measured according to the blow-off method using iron powder (200/300 mesh), it had a triboelectric charge amount of −21.2 μC/g.

When the cyan toner was observed with an optical microscope (magnification = 100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.8 wt. part of negatively chargeable hydrophobic colloidal silica was mixed with 100 wt. parts of the magenta toner prepared above, thereby to prepare a magenta toner comprising toner particles having colloidal silica on their surfaces. 8 wt. parts of the magenta toner containing the colloidal silica attached to the toner particle surfaces was mixed with 92 wt. parts of ferrite carrier coated with styrene-acrylic resin, thereby to prepare a two-component developer.

The two-component developer was charged into a copying machine (trade name: CLC-1, mfd. by Canon K.K. and subjected to successive image formation of 20,000 sheets. As a result, the magenta toner images formed on plain paper had high quality without fog, showed a magenta color having good spectral reflection characteristic and had a stable image density of 1.4 or higher. Further, when toner images were transferred to an OHP film in the same manner as described above, magenta toner images having good light-transmissive property were obtained.

EXAMPLE 6

5 wt. parts of hydrophilic colloidal silica fine powder (trade name: Aerosil 200, mfd. by Nihon Aerosil) showing negative polarity in water was added to 1200 wt. parts of ion-exchanged water, and dispersed therein at 70° C. by means of a strong-shear force stirrer (TK-type Homomixer M, mfd. by Tokushu Kika Kogyo) at 10,000 rpm for 15 min, to prepare an aqueous dispersion medium.

| | |
|---|---|
| Styrene | 183 wt. parts |
| 2-Ethylhexyl acrylate | 17 wt. parts |
| Paraffin Wax T-550 (mfd. by Taisei Kosan) | 32 wt. parts |
| Styrene-dimethylaminothyl methacrylate (copolymerization weight ratio = 9:1, Mn = 20,000) | 10 wt. parts |
| Magenta-type organic pigment (prepared in the above Lipophilicity-imparting Treatment Example 3) | 10 wt. parts |

The above ingredients were heated in a container up to 70° C. and were dissolved or dispersed by means of an ultrasonic dispersing device (10 KHz, 200W), thereby to obtain a monomer mixture. Further, while the mixture was maintained at 70° C., 10 wt. parts of a polymerization initiator (trade name: V-601, mfd. by Wako Junyaku) was added to the mixture and dissolved therein, thereby to prepare a monomer composition.

To the above-mentioned aqueous dispersion medium contained in a flask, the resultant composition was added, and the resultant mixture was stirred in an $N_2$-atmosphere at 70° C. for 60 minutes by means of a TK-homomixer (mfd. by Tokushu Kika Kogyo K.K.) rotating at 7,500 rpm to granulate the monomer composition, thereby to prepare a dispersion. The dispersion was then subjected to polymerization under heating and stirring by means of a paddle stirrer for 20 hours at 70° C.

After the completion of the polymerization, the reaction product was cooled to room temperature and sodium hydroxide was added thereto to dissolve the dispersant. Thereafter, the resultant product was subjected to filtration, washing and drying, thereby to obtain a magenta toner.

The thus obtained magenta toner had a volume-average particle size of 11.6 microns, when measured by means of Coulter Counter with a 100 micron-aperture. The triboelectric charge amount of the resultant cyan toner was measured according to the blow-off method, it had a triboelectric charge amount of $+13\ \mu C/g$.

When the magenta toner was observed with an optical microscope (magnification = 100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.5 wt. part of positively chargeable hydrophobic colloidal silica treated with amino-modified silicone oil was mixed with 100 wt. parts of the magenta toner prepared above, thereby to prepare a magenta toner comprising toner particles having colloidal silica on their surfaces. 5 wt. parts of the magenta toner containing the colloidal silica attached to the toner particle surfaces was mixed with 95 wt. parts of ferrite carrier coated with styrene-acrylic resin, thereby to prepare a two-component developer.

The two-component developer was charged into a copying machine (trade name: NP-3525, mfd. by Canon K.K.) and subjected to successive image formation of 20,000 sheets. As a result, the copied images formed on plain paper were clear without fog, showed a magenta color having good spectral reflection characteristic and had a stable image density of 1.4 or higher.

EXAMPLE 7

A polymerization toner was prepared in the same manner as in Example 4 except for using 10 wt. parts of the magenta-type pigment obtained in the Lipophilicity-Imparting Treatment Example 4, as the colorant.

The thus obtained magenta toner had a volume-average particle size of 11.2 microns and a sharp particle size distribution, when measured by means of Coulter Counter with a 100 micron-aperture.

The triboelectric charge amount of the resultant magenta toner was measured according to the blow-off method using iron powder (200/300 mesh) it had a triboelectric charge amount of $-18\ \mu C/g$.

When the magenta toner was observed with an optical microscope (magnification = 100 to 200), it was found that organic pigment particles were uniformly dispersed in the toner particles, the organic pigment was contained even in toner particles having a particle size of 2 microns or smaller. Further, toner particles containing no organic pigment were not substantially observed.

0.8 wt part of negatively chargeable hydrophobic colloidal silica (Tullanox 500, mfd. by Tulco. Co.) was mixed with 100 wt. parts of the magenta toner.

8 wt. parts of the resultant magenta toner containing the colloidal silica attached to the toner particle surfaces was mixed with 92 wt parts of ferrite carrier coated with styrene-acrylic resin, thereby to prepare a two-component developer.

The two-component developer was charged into a copying machine for color image-formation (trade name: CLC-1, mfd. by Canon K.K.) and subjected to successive image formation of 20,000 sheets. As a result, the copied images formed on plain paper were clear without fog, showed a magenta color having good spectral reflection characteristic and had a stable image density of 1 4 or higher. Further, when toner images were transferred to an OHP film and fixed thereto in the same manner as described above, magenta toner images having good light-transmissive property were obtained.

COMPARATIVE EXAMPLE 3

A cyan toner was prepared in the same manner as in Example 4 except that copper phthalocyanine blue (C.I. Pigment Blue 15:3) which had not been treated with octadecyl isocyanate was used.

The thus obtained cyan toner had a volume-average particle size of 10.9 microns, when measurement by means of Coulter Counter TA-11 with a 100 micron-aperture.

When the triboelectric charge amount of the resultant cyan toner was measured according to the blow-off method using iron powder (200/300 mesh), it had a triboelectric charge amount of −24 μC/g.

When the cyan toner was observed with an optical microscope, it was found that the toner particles having a particle size of above 2 microns contained the pigment but about 40% by number (based on the total number of toner particles of 2 microns or below) of toner particles having a particle size of 2 microns or smaller contained no organic pigment.

COMPARATIVE EXAMPLE 4

A magenta toner was prepared in the same manner as in Example 1 except that quinacridone magenta (C.I. Pigment Red 122) which had not been treated with octadecyl isocyanate was used as the organic pigment.

The thus obtained magenta toner had a volume-average particle size of 11.2 microns, when measured by means of Coulter Counter TA-11 with a 100 micron-aperture.

When the triboelectric charge amount of the resultant magenta toner was measured according to the blow-off method using iron powder (200/300 mesh), it had a triboelectric charge amount of −19 μC/g.

When the magenta toner was observed with an optical microscope, it was found that the particles having a particle size of above 2 microns contained the organic pigment but about 33% by number (based on the total number of toner particles of 2 microns or below) of toner particles having a particle size of 2 microns or smaller contained no organic pigment.

EXAMPLE 8

A yellow toner and a two-component developer were prepared in the same manner as in Oxidation Treatment Example 1, Lipophilicity-Imparting Treatment Example 1 and Example 4, except for using C.I. Pigment Yellow 17.

By using the thus prepared two-component developer, the two-component developer for cyan prepared in Example 4, and the two-component developer for magenta prepared in Example 5, image formation tests were conducted by means of a copying machine (CLC-1, mfd. by Canon K.K.) with respect to the respective mono-color images, color-mixed images and full-color images. As a result, good color images and full-color images were obtained.

The chromaticity values, saturation values and spectral transmittances of the resultant yellow, magenta, cyan, red (superposition of magenta and yellow), blue (superposition of magenta and cyan) and green (superposition of cyan and yellow) toner images. The results are shown in Table 3 appearing hereinafter.

COMPARATIVE EXAMPLE 5

By using the two-component developer for cyan prepared in Comparative Example 3, and the two-component developer for magenta prepared in Comparative Example 4, image formation tests were conducted in the same manner as in Example 8.

The results are shown in Table 3 appearing hereinafter.

TABLE 3

| Toner and color thereof | a* | b* | c* | L* | Spectral transmittance (wavelength for measurement) |
|---|---|---|---|---|---|
| Cyan toner of Ex. 4 | −12.2 | −45.6 | 47.2 | 49.2 | 56% (460 nm) |
| Magenta toner of Ex. 5 | 63.0 | −22.1 | 66.7 | 55.8 | 56% (660 nm) |
| Yellow toner of Ex. 8 | −17.8 | 72.8 | 75.0 | 90.7 | 58% (560 nm) |
| Red *1 | 48.0 | 22.4 | 53.0 | 54.5 | 54% (660 nm) |
| Blue *2 | 22.1 | −46.0 | 51.0 | 33.9 | 52% (460 nm) |
| Green *3 | −45.6 | 1.6 | 45.6 | 45.8 | 56% (560 nm) |
| Cyan toner of Comp. Ex. 3 | −14.3 | −44.8 | 47.2 | 54.0 | 44% (460 nm) |
| Magenta toner of Comp. Ex. 4 | 55.4 | −16.8 | 57.5 | 61.4 | 46% (660 nm) |
| Blue *4 | 19.5 | −44.3 | 48.4 | 37.8 | 36% (460 nm) |

*1: (Magenta toner of Ex. 5) + (Yellow toner of Ex. 8)
*2: (Cyan toner of Ex. 4) + (Magenta toner of Ex. 5)
*3: (Cyan toner of Ex. 4) + (Yellow toner of Ex. 8)
*4: (Cyan toner of Comp. Ex. 3) + (Magenta toner of Comp. Ex. 4)

As apparent from the above Table 3, the color toners according to the present invention were superior to those of Comparative Examples in color tone, color-mixing property, and transmissive property for OHP images.

What is claimed is:

1. A process for producing a color toner, comprising:

mixing a polymerizable monomer and an organic pigment having —OH groups treated with an isocyanic ester or silicon-containing compound, thereby to prepare a monomer composition;

adding the monomer composition to an aqueous dispersion medium;

forming particles of the monomer composition in the aqueous dispersion medium;

polymerizing the polymerizable monomer contained the monomer composition particles, thereby to produce colored resinous particles; and producing a color toner from the colored resinous particles.

2. A process according to claim 1, wherein the isocyanic ester comprises a compound represented by a formula:

$$R—N=C=O$$

wherein R is an alkyl group having 1–20 carbon atoms and containing no active hydrogen, (ii) an alkenyl group, (iii) an alkyl group having 1–20 carbon atoms containing no active hydrogen and containing at least one species selected form the group consisting of N, S, O and halogen atom, (iv) an alkenyl group containing no active hydrogen and containing at least one species selected form the group consisting of N, S, O and halogen atom or (v) an aryl group.

3. A process according to claim 1, wherein the silicon-containing compound comprises at least one species selected from the group consisting of: γ-(2-aminoethyl)aminopropyltrimethoxysilane, γ-aminopropyltriethoxysilane, γ-(2-aminoethyl)aminopropylmethyldimethoxysilane, γ-methacryloxypropyltrimethoxysilane, γ-glycidoxypropyltrimethoxysilane, methyltrimethoxysilane, ethyltriethoxysilane, γ-anilinopropyltrimethoxysilane, vinyltrimethoxysilane, and γ-chloropropylmethyldimethoxysilane.

4. A process according to claim 1, wherein the silicon-containing compound comprises a silicone compound represented by the following formula [I]:

$$(R_1HSiO)_a(R_2R_3SiO)_b(R_4R_5R_6SiO_{\frac{1}{2}})_c \qquad [I],$$

wherein $R_1$, $R_2$ and $R_3$ respectively are the same or different groups each of which is a hydrogen atom or a hydrocarbon group having 1–10 carbon atoms and being capable of having a substituent of a halogen atom, provided that all of $R_1$, $R_2$ and $R_3$ are not hydrogen L. atoms simultaneously; $R_4$, $R_5$ and $R_6$ respectively are the same or different groups each of which is a hydrogen atom or a hydrocarbon group having 1–10 carbon atoms and being capable of having a substituent of a halogen atom; a is zero or an integer of 1 or larger; b is zero or an integer of 1 or larger; c is zero or an integer of 2, provided that the sum of (a+b) is an integer of 3 or larger in a case where C=0.

5. A process according to claim 4, wherein the silicon-containing compound comprises a compound represented by the following formula [II] or [III]:

$$(R_1HSiO)_a(R_2R_3SiO)_b \qquad [II],$$

wherein $R_1$, $R_2$ and $R_3$ respectively are each an aryl group or lower alkyl group having 1–4 carbon atoms and being capable of having a substituent of a halogen atom, and the sum of (a+b) is 3 to 7; or $$(R_1HSiO)_a(R_2R_3SiO)_b(R_4R_5R_6SiO_{\frac{1}{2}})_2 \qquad [III],$$

wherein $R_1$ to $R_6$ respectively are each an aryl group or lower alkyl group having 1–4 carbon atoms and being capable of having a substituent of a halogen atom, and the sum of (a+b) is 2 to 5.

6. A process according to claim 5, wherein the silicon-containing compound comprises a compound represented by a formula:

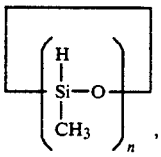

wherein n denotes an integer of 3 to 7.

7. A process according to claim 5, wherein the silicon-containing compound comprises a compound represented by a formula:

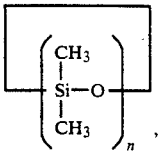

wherein n denotes an integer of 3 to 7.

8. A process according to claim 5, wherein the silicon-containing compound comprises a compound represented by a formula:

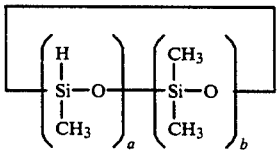

wherein the sum of (a+b) denotes an integer of 3 to 7.

9. A process according to claim 5, wherein the silicon compound comprises a cyclic silicone compound selected from the group consisting of: dihydrogenhexamethylcyclotetrasiloxane, trihydrogenpentamethylcyclotetrasiloxane, tetrahydrogentetramethylcyclotetrasiloxane, dihydrogenoctamethylcyclopentasiloxane, trihydrogenheptamethylcyclopentasiloxane, tetrahydrogenhexamethylcyclopentasiloxane, and pentahydrogenpentamethylcyclopentasiloxane.

10. A process according to claim 5, wherein the silicon compound comprises a linear silicone compound selected from the group consisting of: 1,1,1,2,3,4,4,4-octamethyltetrasiloxane, 1,1,1,2,3,4,5,5,5-nonamethylpentasiloxane, and 1,1,1,2,3,4,5,6,6,6-decamethylhexasiloxane.

11. A process according to claim 1 including employing 0.5–50 wt. parts of the isocyanic ester for the treatment with respect to 10 wt. parts of he organic pigment particles.

12. A process according to claim 1 including employing 0.005–50 wt. parts of the isocyanic ester for the treatment on the basis of the weight of the organic pigment particles.

13. A process according to claim 1 including treating the organic pigment particles with an isocyanic ester or a silicon-containing compound, after the organic pigment particles have been subjected to oxidation treatment thereof.

14. A process according to claim 13, including oxidation treating the organic pigment particles so as to provide an —OH group on their surfaces.

15. A process according to claim 1 including providing the organic pigment particles with an —OH group, and treating —OH group containing organic pigment particles with the isocyanic ester or silicon-containing compound so that the —OH group reacts with the isocyanic ester or silicon compound.

16. A process according to claim 1 including treating the organic pigment particles so that their surfaces are oxidized to provide an —OH group thereon, and further treating with an isocyanic ester or a silicon-containing compound so that the —OH group reacts with the isocyanic ester or silicon-containing compound.

17. A process according to claim 1, wherein the organic pigment particles are present in an amount of 0.1–50 wt. parts per 100 wt. parts of the polymerizable monomer.

18. A process according to claim 1, wherein the organic pigment particles are present in an amount of 0.5–25 wt. parts per 100 wt. parts of the polymerizable monomer.

19. A process according to claim 1, wherein the polymerizable monomer comprises a vinyl-type monomer.

20. A process according to claim 1, wherein the polymerizable monomer comprises styrene.

* * * * *

UNITED STATES PATENT AND TRADEMARK OFFICE

CERTIFICATE OF CORRECTION

PATENT NO. : 5,166,032

DATED : November 24, 1992

INVENTOR(S) : TATSUYA NAKAMURA, ET AL.

It is certified that error appears in the above-identified patent and that said Letters Patent is hereby corrected as shown below:

IN [57] ABSTRACT

Line 1, "cooler" should read --color--.

COLUMN 2

Line 14, "Polymerization-" should read --polymerization- --.
Line 22, "become spoor," should read --becomes poor,--.
Line 24, "an" should read --and--.
Line 36, "int eh" should read --in the--.

COLUMN 4

Line 14, "sowing" should read --showing--.
Line 65, "sued" should read --used--.

COLUMN 5

Line 38, "isocyanate" should read --isocyanate.--.
Line 67, "propyltirmethoxysilane," should read --propyltrimethoxysilane--.

COLUMN 6

Line 50, "$(R_1HSiO)_a(R_2R_3SiO)_b(R_4R_5R_6SiO_{178})_2$ [III]," should read --$(R_1HSiO)_a(R_2R_3SiO)_b(R_4R_5R_6SiO)_2$ [III],--.

COLUMN 9

Line 44, "below" should read --below,--.

UNITED STATES PATENT AND TRADEMARK OFFICE

CERTIFICATE OF CORRECTION

PATENT NO. : 5,166,032

DATED : November 24, 1992

INVENTOR(S) : TATSUYA NAKAMURA, ET AL.

It is certified that error appears in the above-identified patent and that said Letters Patent is hereby corrected as shown below:

COLUMN 10

Line 51, "is" should read --are--.

COLUMN 11

Line 8, "signly" should read --singly--.

COLUMN 12

Line 27, "axobis" should read --azobis--.
Line 33, "int he" should read --in the--.
Line 54, "certain" should read --curtain--.
Line 56, "threat." should read --thereat.--.

COLUMN 15

Line 63, "dimethnylamino" should read --dimethylamino--.

COLUMN 16

Line 3, "he" should read --the--.

COLUMN 22

Line 1, "method," should read --method and--.

COLUMN 24

Line 52, "contained" should read --containing--.
Line 63, "is an" should read --is (i) an--.
Line 67, "form" should read --from--.

--

UNITED STATES PATENT AND TRADEMARK OFFICE

CERTIFICATE OF CORRECTION

PATENT NO. : 5,166,032

DATED : November 24, 1992

INVENTOR(S) : TATSUYA NAKAMURA, ET AL.

It is certified that error appears in the above-identified patent and that said Letters Patent is hereby corrected as shown below:

COLUMN 25

Line 2, "form" should read --from--.
Line 25, "L." should be deleted.

COLUMN 26

Line 35, "con compound" should read --con-containing compound--.
Line 42, "he" should read --the--.

Signed and Sealed this

Thirtieth Day of November, 1993

Bruce Lehman

*Attest:*

BRUCE LEHMAN

*Attesting Officer*

*Commissioner of Patents and Trademarks*